US009452473B2

(12) United States Patent
Barrett et al.

(10) Patent No.: US 9,452,473 B2
(45) Date of Patent: Sep. 27, 2016

(54) METHODS FOR CASTING AGAINST GRAVITY

(71) Applicant: PCC Structurals, Inc., Portland, OR (US)

(72) Inventors: James Raphord Barrett, Milwaukie, OR (US); Michael Snow, Farmington, UT (US)

(73) Assignee: PCC STRUCTURALS, INC., Portland, OR (US)

( * ) Notice: Subject to any disclaimer, the term of this patent is extended or adjusted under 35 U.S.C. 154(b) by 334 days.

(21) Appl. No.: 13/827,852

(22) Filed: Mar. 14, 2013

(65) Prior Publication Data

US 2014/0271341 A1 Sep. 18, 2014

(51) Int. Cl.

| | |
|---|---|
| ***B22D 18/04*** | (2006.01) |
| ***B22D 18/06*** | (2006.01) |
| ***B22D 27/04*** | (2006.01) |
| ***B22D 30/00*** | (2006.01) |
| ***B22D 23/00*** | (2006.01) |
| ***B22C 9/04*** | (2006.01) |

(52) U.S. Cl.

CPC ..... *B22D 23/00* (2013.01); *B22C 9/04* (2013.01); *B22D 18/04* (2013.01); *B22D 18/06* (2013.01); *B22D 27/04* (2013.01); *B22D 30/00* (2013.01)

(58) Field of Classification Search

CPC ..... B22D 18/04; B22D 18/06; B22D 23/00; B22D 27/04; B22D 30/00

USPC ..... 164/62, 63, 254, 255

See application file for complete search history.

(56) References Cited

U.S. PATENT DOCUMENTS

| | | | | |
|---|---|---|---|---|
| 3,635,791 | A | 1/1972 | Bly et al. | |
| 3,863,704 | A | 2/1975 | Kahn | |
| 3,926,245 | A | 12/1975 | Kanaby | |
| 4,901,781 | A | 2/1990 | Ruff | |
| 4,961,455 | A | 10/1990 | Redemske et al. | |
| 4,982,777 | A | 1/1991 | Chandley | |
| 5,146,973 | A | 9/1992 | Chandley | |
| 5,263,533 | A | 11/1993 | Druschitz et al. | |
| 5,303,762 | A | 4/1994 | Chandley | |
| 5,529,645 | A * | 6/1996 | Oswalt | B22D 25/02 148/437 |

(Continued)

FOREIGN PATENT DOCUMENTS

| | | |
|---|---|---|
| EP | 0571703 | 1/1993 |
| JP | H0569106 | 3/1993 |
| JP | H11192544 | 7/1999 |

OTHER PUBLICATIONS

International Search Report and Written Opinion of PCT/US2014/023323 Jun. 18, 2014.

*Primary Examiner* — Kevin P Kerns

(74) *Attorney, Agent, or Firm* — Burris Law, PLLC

(57) ABSTRACT

Methods of manufacturing castings are described. The method can include heating a ceramic mold having a gate inlet, and melting a metallic composition. The method can also include presenting the ceramic mold to a casting station such that the gate inlet is in fluid communication with the molten metallic composition, and casting against gravity the molten metallic composition into the heated mold through the gate inlet. Furthermore, the method can include rotating the mold to position with the gate inlet in an upward direction while the metallic composition is at least partially molten within the mold, and quenching the molten metallic composition in a liquid quench medium to solidify the molten metallic composition within the mold.

18 Claims, 4 Drawing Sheets

(56) References Cited

U.S. PATENT DOCUMENTS 5,607,007 A * 3/1997 Chandley ..... C30B 11/002 164/122.2
6,499,529 B1 12/2002 Farkas
6,622,774 B2 9/2003 Song
6,637,497 B2 10/2003 Herron
6,889,745 B2 * 5/2005 Redemske ..... B22C 9/043 164/12
7,935,304 B2 5/2011 Lyon et al.
2011/0303384 A1 12/2011 Kennerknecht

* cited by examiner

METHODS FOR CASTING AGAINST GRAVITY

FIELD

This disclosure relates generally to manufacturing a casting. More specifically, this disclosure relates to casting against gravity and quenching castings.

BACKGROUND

The statements in this section merely provide background information related to the present disclosure and may not constitute prior art.

Casting against gravity or counter-gravity casting can be a mold filling technique in which a pressure difference is created between a metallic melt and within a mold. The mold is held above the metallic melt, and cavity within the mold positioned to be in fluid communication with the metallic melt. The pressure within the mold is lowered relative to that around the metallic melt which causes the metallic melt to move against gravity and into the mold. The metallic melt can be solidified within the mold cavity prior to removing the pressure difference. Since the solidification of the cast components occurs while under pressure, the solidification rate may be limited by being air cooled.

SUMMARY

According to one aspect of the present disclosure, a method of manufacturing a casting is provided. The method can include heating a ceramic mold comprising a gate inlet, and melting a metallic composition. The method can also include presenting the ceramic mold to a casting station such that the gate inlet is in fluid communication with the molten metallic composition, and casting against gravity the molten metallic composition into the heated mold through the gate inlet. Furthermore, the method can include rotating the mold to position with the gate inlet in an upward direction while the metallic composition is at least partially molten within the mold, and quenching the molten metallic composition in a liquid quench medium to solidify the molten metallic composition within the mold.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
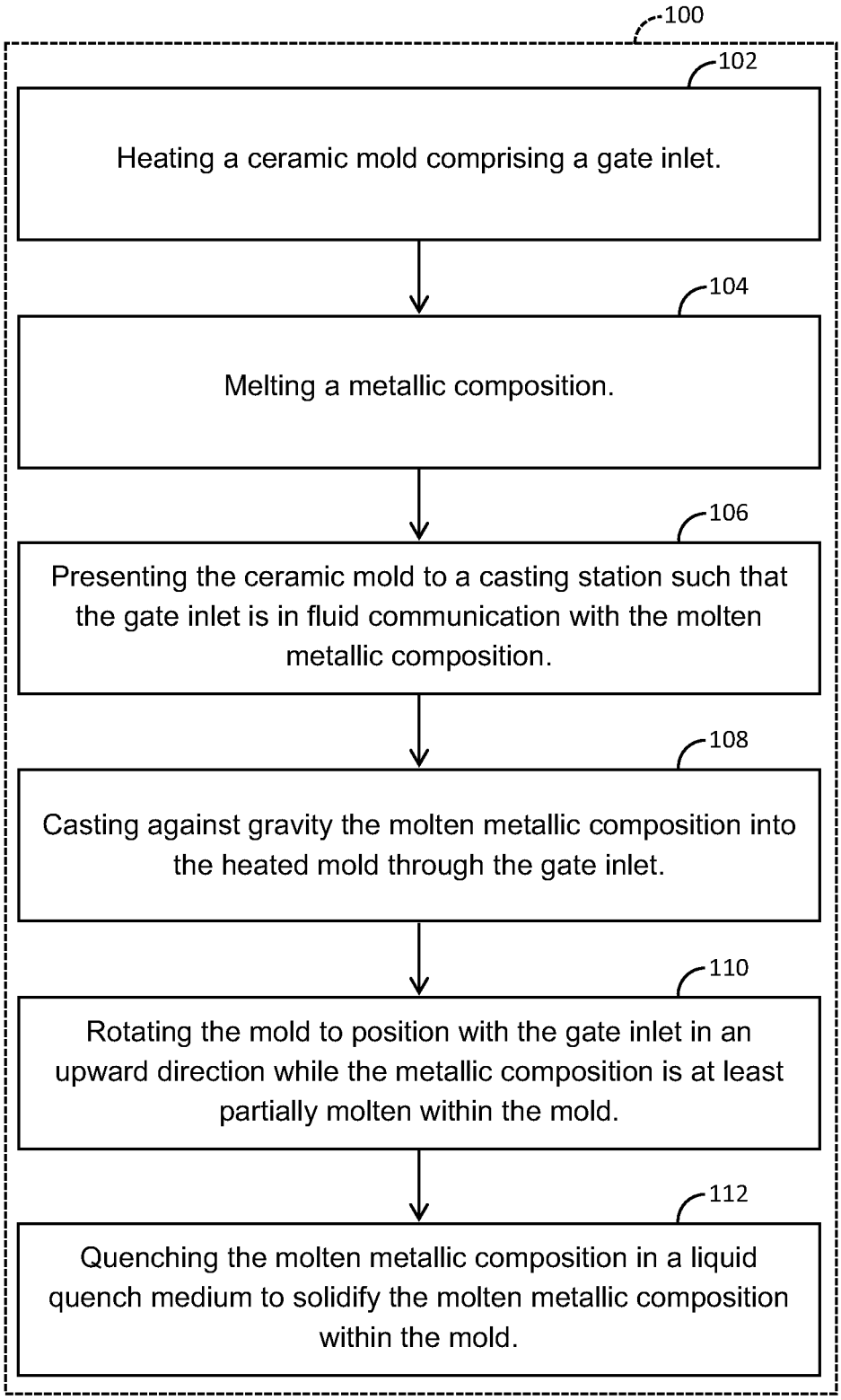
FIG. 1 is a flow diagram of an example method of manufacturing a casting that is compatible with certain aspects of the present disclosure.

The following description is merely exemplary in nature and is in no way intended to limit the present disclosure or its application or uses. It should be understood that throughout the description, corresponding reference numerals indicate like or corresponding parts and features.

The present disclosure generally relates to methods of manufacturing castings and castings manufactured by such methods. The methods and castings made and used according to the teachings contained herein are described through the present disclosure in conjunction with investment casting aluminum in order to more fully illustrate the concept. The use of the methods in conjunction with other types of castings and components is contemplated to be within the scope of the disclosure.

According to certain aspects of the present disclosure, a method of manufacturing a casting is provided. FIG. 1 is a flow diagram of an example method 100 of manufacturing a casting compatible with certain aspects described herein. In operational block 102, the method can include heating a ceramic mold comprising a gate inlet.

Figure 2:
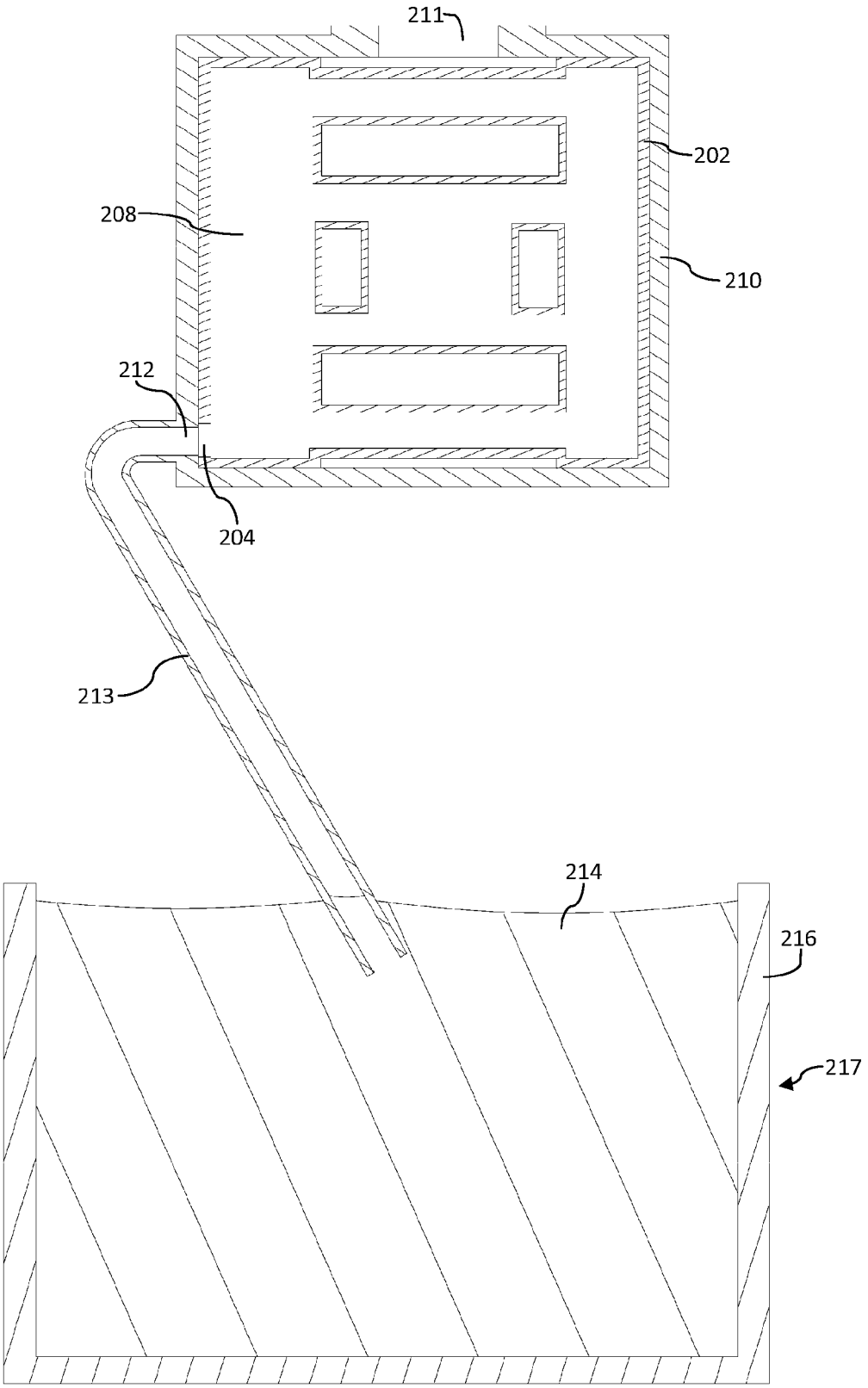
FIG. 2 is a cross-sectional view of an example of a ceramic mold during counter gravity casting that is compatible with certain aspects of the present disclosure.

Referring to FIG. 2, the ceramic mold 202 can include a gate inlet 204 in fluid communication with one or more mold cavities 208. In certain configurations of the mold, a riser passage can also be between and in fluid communication with the gate inlet 204 and the cavities 208 so that the cavities 208 can be in fluid communication with the gate inlet 204. The mold cavities 208 can have a shape of a component or part that will form the casting. For example, the casting can be a component for aerospace, power generation, medical equipment or other metallic part.

The ceramic mold 202 can be at least partially porous to gas (e.g., gas permeable). The ceramic mold 202 can be produced by an investment process. For example, the ceramic mold 202 can be formed from lost wax process where a wax pattern assembly is dipped in a ceramic slurry, coated with refractory particles, dried, and repeated to build up a ceramic shell. The ceramic slurry can be, for example, a suspension of refractory powder such as zircon, alumina, or silica in a liquid binder. The refractory particles that are coated onto the ceramic slurry can be, for example, zircon, alumina, or silica. The wax pattern can then be thermally removed, and the ceramic shell can be fired to form the ceramic mold 202. The walls of the ceramic mold 202 can include porosity and can be permeable to gas while being impermeable to molten metal. Furthermore, as further described below, the ceramic mold 202 can have relatively good thermal conduction/convection in order to control heat removal from a metallic composition cast into the ceramic mold 202.

Figure 3:
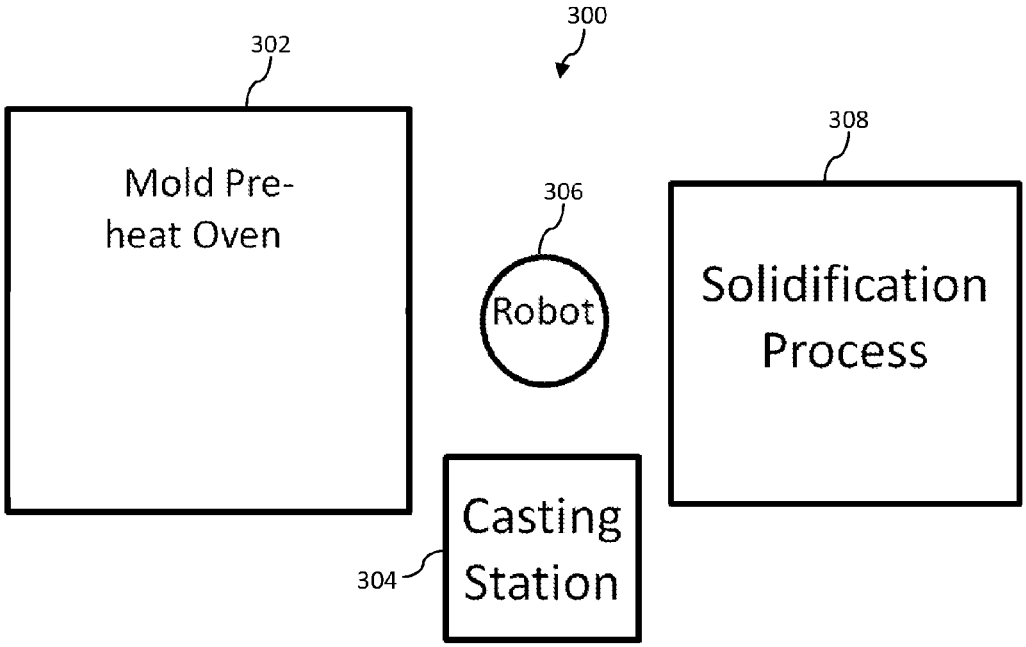
FIG. 3 is a schematic of a system for manufacturing a casting compatible with certain aspects of the present disclosure.

FIG. 3 is a schematic of a system 300 for manufacturing a casting. Prior to casting a metallic composition into the ceramic mold 202, the ceramic mold 202 can be heated in a mold pre-heat oven 302. The ceramic mold 202 can be pre-heated to a selected temperature to control solidification rate of the metallic composition that is cast into the ceramic mold 202. For example, the mold 202 can be pre-heated to a temperature above room temperature such as a temperature near a melt temperature of the metallic composition such as within about 400° C. of the melt temperature of the metallic composition. For example, for aluminum alloys, the ceramic mold 202 can be pre-heated to a temperature of about 200° C. to about 900° C.

In operational block 104 of FIG. 1, the method 100 can include melting a metallic composition to form a molten metallic composition 214. The melting of the metallic composition can be performed in a crucible 216 that will be used in connection with casting, or the melting can be performed in a separate container and then transferred to the crucible 216 for casting. Furthermore, the molten metallic composition 214 can be cleaned with a degassing and fluxing process. A melting chamber 217 can contain the crucible 216 that contains the molten metallic composition 214. The melting can be performed under vacuum or in an inert atmosphere such as argon. Thus, the melting chamber 217 can be evacuated and back-filled with an inert gas such as argon prior to melting of the metallic composition. The melting chamber 217 can be maintained at a pressure at about atmospheric or the melting chamber 217 can have a pressure less than atmospheric. The metallic composition can be melted by various heating methods such as induction or resistive heating. Furthermore, the molten metallic composition 214 may be heated to a superheat temperature that is above the melting temperature of the metallic composition. For example, the superheat temperature may be about 10° C. to about 100° C. above the liquidus melting temperature.

The metallic composition can include various elements that form an alloy. For example, a largest constituent of the metallic composition can be aluminum. Exemplary aluminum alloys include 201/A201, 203, 355/C355, A206, A356, A357, D357, E357 and F357. Other alloys that include a different largest constituent such as iron, titanium, nickel, etc. can be cast with the methods described herein. For example, melting method, atmospheric control, quenching media, etc. can be modified or adjusted depending on the metallic composition.

In operational block 106 of FIG. 1, the method 100 can further include presenting the ceramic mold 202 to a casting station 304 with the gate inlet 204 in a downward or non-upward direction. The ceramic mold 202 can be removed from the pre-heat oven 302 and then presented to the casting station 304 by a robot 306 (e.g., robotic arm) or by hand with a tool (e.g. tongs).

The casting station 304 can include a mold chamber 210. The mold chamber 210 can be configured to be capable of maintaining a vacuum atmosphere (e.g., subambient pressure) within the mold chamber 210. A vacuum pump can be in gaseous communication with the mold chamber 210 configured to create a vacuum in the mold chamber 210. For example, the mold chamber 210 can include a vacuum inlet 211 that is in gaseous communication with a vacuum. Furthermore, the robot arm 306 can include a vacuum port that removably couples to the vacuum inlet 211. As described below, the mold chamber 210 can be configured to be rotatable. For example, mold chamber 210 may be a separate component. The robot arm 306 can be used to rotate the mold chamber 210. Thus, the robot arm 306 can be used to move the mold chamber 210 and provide a vacuum to the mold chamber 210.

The ceramic mold 202, after being pre-heated, can be loaded into the mold chamber 210. The mold chamber 210 can be configured to be opened and closed so that the mold 202 can be loaded and removed from the mold chamber 210. The mold 202 can be loaded into the mold chamber 210 so that the gate inlet 204 can be in fluid communication with an opening 212 of the mold chamber 210 such as on a side or a bottom of the mold chamber 210. The opening 212 can include a seal to provide an air tight seal where the gate inlet 204 and the mold chamber 210 engage. As shown in FIG. 2, the mold chamber 210 can include a filling tube 213 that can be in fluid communication with the gate inlet 204. The filling tube 213 can extend away from the mold chamber 210 and can be configured to extend into the molten metallic composition 214. As shown in FIG. 2, the mold 202 is substantially the same size as the interior of the mold chamber 210. However, the interior of the mold chamber 210 can be larger than the mold 202, and the mold 202 can have various complex shapes. An advantage to having a relatively small interior of the mold chamber 210 is that the relatively small interior results in less volume to evacuate.

In operational block 108 of FIG. 1, the method 100 can include casting against gravity the molten metallic composition 214 into the heated ceramic mold 202 through the gate inlet 204. After the ceramic mold 202 has been positioned within the mold chamber 210, the mold chamber 210 can be evacuated and optionally back-filled with an inert gas such as argon. The mold chamber 210 can be maintained at a pressure at about atmospheric or the mold chamber 210 can have a pressure less than atmospheric. Since the mold chamber 210 is in gaseous communication with the cavities 208 of the mold 202, the cavities 208 can have substantially the same pressure as the mold chamber 210. As described above, the melting chamber 217 can be at or below atmospheric pressure. Thus, prior to casting, the pressure within the mold chamber 210 and the melting chamber 217 can both be at or below atmospheric pressure. The mold chamber 210 and the melting chamber 217 may even have a pressure that is substantially the same. Alternatively, the mold chamber 210 and/or the melting chamber 217 may have a pressure greater than atmospheric.

In order to cast the molten metallic composition 214 into the mold 202, the gate inlet 204 and/or the filling tube 213 can be placed into fluid communication with the molten metallic composition 214. For example, the filling tube 213 can be inserted into the molten metallic composition 214. While the filling tube 213 is in the molten metallic composition 214, the gate inlet 204 can be pointed in a non-upward direction. For example, the gate inlet 204 can be at or near a bottom of the mold 202 to reduce turbulence during casting. The filling tube 213 can be inserted into the molten metallic composition 214 with the robot arm 306. For example, the robot arm 306 can move and position the mold chamber 210 so that the filling tube 213 is in a downward direction, and the robot arm 306 can insert the filling tube 213 into the molten metallic composition 214. After the gate inlet 204 is in fluid communication with the molten metallic composition 214, the melting chamber 217 can be gaseously isolated from the mold chamber 210. For example, the molten metallic composition 214 in the gate inlet 204 and/or the filling tube 213 can prevent gas from the melting chamber 217 from entering the gate inlet 204 and/or the filling tube 213. Furthermore, the gate inlet 204 and/or the filling tube 213 can be impermeable to gas.

As described above, a vacuum pump can be in gaseous communication with the mold chamber 210. After the gate inlet 204 is in fluid communication with the molten metallic composition 214, a vacuum can be created around the heated mold 202 to pull the molten metallic composition 214 into the gate inlet 204. The pressure in the mold chamber 210 can be decreased relative to pressure in the melting chamber 217 and around the molten metallic composition 214. Thus, a pressure differential can be created between a mold chamber 210 containing the heated mold 202 and the melting chamber 217 containing the molten metallic composition 214 such that the melting chamber 217 comprises a pressure greater than a pressure in the mold chamber 210 that results in the molten metallic composition 214 flowing against gravity and into the heated mold 202. For example, the pressure difference can cause the molten metallic composition 214 to flow into the gate inlet 204 and into the mold cavities 208. The pressure within the mold chamber 210 can be, for example, decreased to between about 20 kPa and about 70 kPa. When the pressure within the mold chamber 210 is decreased, the melting chamber 217 can maintain a pressure of about 80 kPa to about atmospheric. The pressure difference between the mold chamber 210 and the melting chamber 217 can be about 20 kPa to about 80 kPa. Furthermore, the pressure within the melting chamber 217 can be increased when the pressure within the mold chamber 210 is decreased to further increase the pressure difference. For example, the pressure in the melting chamber 217 can be increased to above atmospheric pressure. Casting against gravity can result in lower turbulent flow of the molten metallic composition which can result in reduced oxide content compared to gravity filled processes.

Described above is one example method of casting against gravity. Other methods of casting against gravity are also compatible with the present disclosure. For example, casting against gravity can include pumping the molten metallic composition against gravity into the heated mold. In a further example, casting against gravity can include injecting (e.g., upward injecting) the molten metallic composition against gravity into the heated mold.

After the molten metallic composition 214 has filled the cavities 208, the gate inlet 204 and/or the filling tube 213 can be removed from being in fluid communication with the molten metallic composition 214 that is in the crucible 216 while the pressure within the mold chamber 210 remains under vacuum to keep the molten metallic composition 214 within the cavities 208. Some molten metallic composition 214 may flow out of the gate inlet 204 and/or the filing tube 213. The gate inlet 204 can be exposed to air and cool more rapidly than the rest of the ceramic mold 202 that is within the mold chamber 210. Thus, the metallic composition 214 in the gate inlet 204 solidifies while the remaining metallic composition 214 in the ceramic mold 202 remains molten which can prevent the molten metallic composition 214 from flowing out the gate inlet 204.

In operational block 110 of FIG. 1, the method 100 can include rotating the ceramic mold 202 to position with the gate inlet 204 in an upward direction while the metallic composition is at least partially molten within the mold 202. While the mold chamber 210 is under vacuum, the mold chamber 210 can be positioned and/or rotated so that the gate inlet 204 is in an upward, upright and/or non-downward direction. In one example, the rotation can include rotating the ceramic mold 202 180° so that the gate inlet 204 moves from being at the bottom of the ceramic mold 202 to being at the top of the ceramic mold 202. In another example, the ceramic mold 202 is rotated 90° so that the gate inlet 204 moves from being on a vertical side of the ceramic mold 202 to being on the top of the ceramic mold 202. The rotation can be about a point at or near the vacuum inlet 211. After the gate inlet 204 is in an upward direction, the pressure within the mold chamber 210 can be returned to atmospheric pressure (e.g., removing the applied vacuum). By having the gate inlet 204 in an upward direction, the molten metallic composition 214 may not flow out of the cavities 208 of the mold 202. The ceramic mold 202 can then be removed from the mold chamber 210. The robot 306 can be used to remove the ceramic mold 202 with the metallic composition from the casting station, and the robot 306 can be used to rotate the mold 202.

In operational block 112, the method 100 can include quenching the molten metallic composition 214 in a liquid quench medium to solidify the molten metallic composition 214 within the mold 202. For example, the robot 306 can move the ceramic mold 202 to a solidification station 308. The ceramic mold 202 may be moved to the solidification station 308 while the mold 202 is still within the mold chamber 210. The mold chamber 210 may then be completely removed or partially removed from the mold 202. For example, portions of the mold chamber 210 may be separated from other portions of the mold chamber 210 so that some portions of the mold chamber 210 may remain with the mold 202 out of convenience. For example, a portion of the mold chamber 210 that mold 202 rests on may remain. Thus, at least a portion of the mold chamber 210 may go through the quenching process with the mold 202.

Although, the molten metallic composition 214 may partially solidify, the metallic composition 214 can remain at least partially molten until the metallic composition 214 is quenched. For example, as described above, the metallic composition 214 in the gate inlet 204 may solidify before quenching while the metallic composition 214 in the mold cavity 208 may remain molten. In addition, the ceramic mold 202 may be rapped or covered with a thermally insulating material prior to being placed into the mold chamber 210 to reduce the cooling rate of the ceramic mold 202 and the molten metallic composition 214 while the mold transitions from casting station 304 to the solidification station 308. The thermally insulating material can then be removed prior to quenching the molten metallic composition 214.

Figure 4:
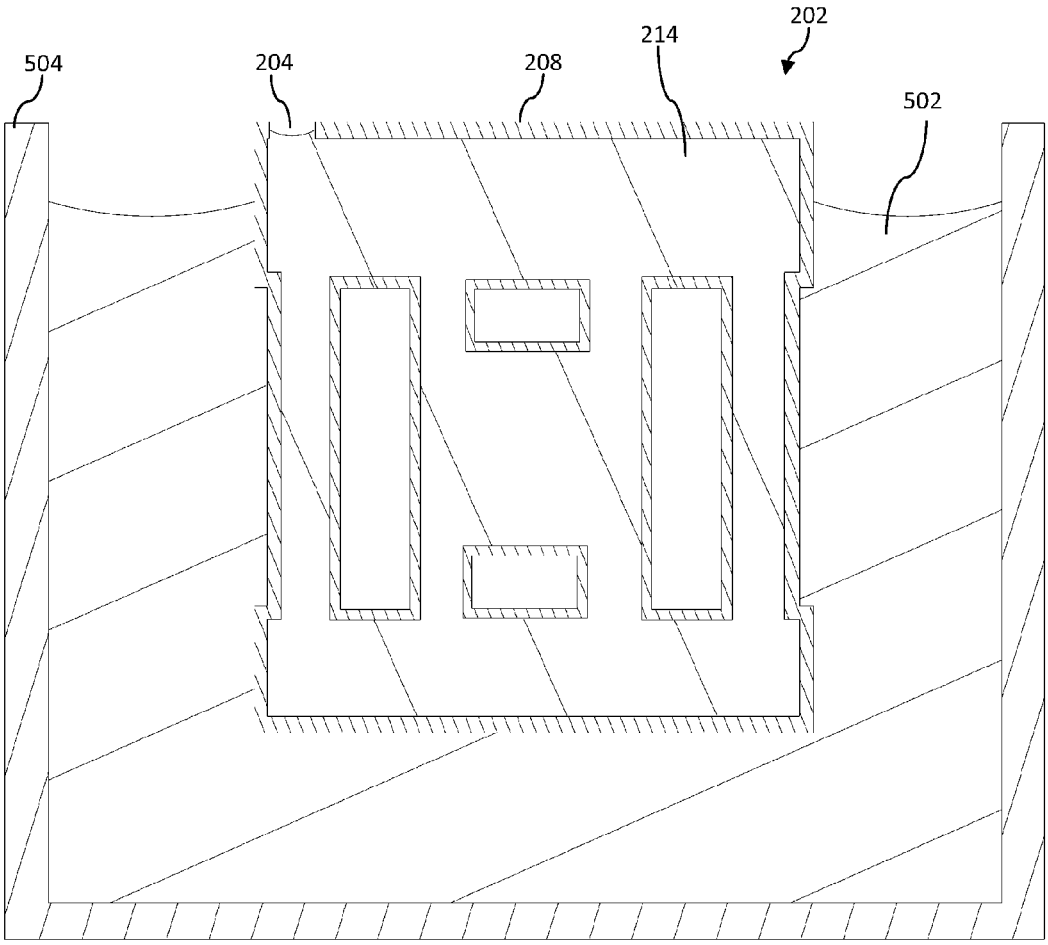
FIG. 4 is a cross-sectional view of an example of a ceramic mold with a metallic composition cast into the mold being quenched that is compatible with certain aspects of the present disclosure.

Referring to FIG. 4, the metallic composition 214 can be quenched by submerging or immersing the ceramic mold 202 into a liquid quench medium 502. The quenching of the metallic composition 214 provides control over the cooling rate and solidification rate of the metallic composition. Thus, the resulting microstructure of the metallic composition 214 can be controlled. The ceramic mold 202 can be submerged with the gate inlet 204 at the top of the ceramic mold 202. The liquid quench medium 502 can be contained in a quenching container 504. The submersion rate in which the ceramic mold 202 is inserted into the liquid quench medium 502 can vary depending on composition of the metallic composition and desired microstructure. For example, the submersion rate can be about 10 mm/s to about 100 mm/s. Furthermore, the submersion rate can be at a substantially steady or constant rate. A steady rate can result in a uniform microstructure throughout the casting. The temperature of the liquid quench medium 502 can be selected based on desired cooling rate of the metallic composition. For example, the temperature of the liquid quench medium 502 can be below room temperature, can be at about room temperature, or can be above room temperature such as between about 30° C. and about 90° C.

The solidification rate of the metallic composition can be substantially the same as the submersion rate or the solidification rate may be different from the submersion rate. For example, if the mold 202 is submerged at a relatively low rate, the solidification rate may be substantially the same as the submersion rate. If the mold 202 is inserted at a relatively high rate, the solidification rate may be less than the submersion rate. The mold 202 may be submerged into the quench medium 502 at a rate such that the quench medium 502 remains behind a solidification front of the metallic composition. For example, the metallic composition can be cooled at a rate of at least about 10° C./s or cooled at a rate of between about 10° C./s and about 50° C./s until solidification completes during the quenching. Furthermore, the mold 202 can be maintained within the quench medium 502 after solidification in order to maintain a cooling rate higher than that of air cooling. For example, a desired microstructure may be able to be obtained with a higher cooling rate after solidification such as ensuring that dissolved constituents of an alloy remain in solution. For example, aluminum alloys may be quenched until the alloy reaches a temperature below 300° C. Using the liquid quench medium 502 to quench the casting can provide additional control of the solidification rate and less variation between castings compared to air cooling.

The liquid quench medium 502 can comprise a polymer. For example, the polymer can include polyalkylene glycol, sodium polyacrylate, polyvinyl pyrolidone, polyethyl oxazoline, poly-oxyethylene glycol or a combination thereof. Such polymers can be aqueous polymers and the quench medium 502 can also include water. For example, the liquid quench medium 502 may comprise about 5 weight percent to about 30 weight percent of the polymer. The remainder of the liquid quench medium 502 can be water. The composition of the liquid quench medium 502 can be selected to provide a desired quench rate. In one example, the liquid quench medium 502 is or includes Aqua-Quench® C polymer quenchant from Houghton™ (Norristown, Pa.). In addition, the liquid quench medium 502 can be agitated during quenching to increase the quench rate. Furthermore, other liquid quench mediums 502 can be used such as non-polymer quenchants such as oil. Furthermore, the material of the ceramic mold 202 can be selected to have a thermal conductivity to provide a desired cooling rate of the metallic composition. For example, a ceramic mold 202 that has a relatively higher thermal conductivity can result in a higher cooling rate of the metallic composition.

After the metallic composition has solidified, the mold 202 can be removed from the quench medium 502. The mold 202 can then be removed from the metallic composition, and the cast components can be removed from the gating and cleaned. The cast components may then go through various post-casting processes such as inspection and heat treatment.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method of manufacturing a casting comprising:

heating a ceramic mold comprising a gate inlet, the ceramic mold being formed by investment casting;

melting a metallic composition;

presenting the heated ceramic mold to a casting station such that the gate inlet is in fluid communication with the molten metallic composition;

casting against gravity the molten metallic composition into the heated mold through the gate inlet;

rotating the mold to position with the gate inlet in an upward direction while the metallic composition is at least partially molten within the mold;

quenching the ceramic mold having the molten metallic composition in an aqueous polymer quench medium, at a desired quench rate;

solidifying the molten metallic composition within the mold at a solidification rate that is controllable by the quench rate; and controlling the solidification rate by controlling the quench rate.

2. The method of claim 1, wherein a largest constituent of the metallic composition is aluminum.

3. The method of claim 1, wherein the gate inlet is in fluid communication with a cavity within the mold.

4. The method of claim 1, wherein the ceramic mold is at least partially porous to gas.

5. The method of claim 1, wherein the casting against gravity comprises creating a vacuum around the ceramic mold to pull the molten metallic composition into the gate inlet.

6. The method of claim 5, wherein the vacuum around the ceramic mold is maintained until the mold has been rotated so that the gate inlet is in the upward direction.

7. The method of claim 1, wherein the heating of the ceramic mold comprises placing the ceramic mold into an oven to heat the ceramic mold and removing the ceramic mold from the oven prior to presenting the ceramic mold to the casting station.

8. The method of claim 7, wherein removing the heated mold from the oven and presenting the heated mold to a casting station is by a robotic arm.

9. The method of claim 1, wherein the quenching of the ceramic mold having the molten metallic composition comprises submerging the ceramic mold into the liquid quench medium at a steady rate.

10. The method of claim 1, wherein the metallic composition is cooled at a rate of at least about 10° C./s during the quenching.

11. The method of claim 1, wherein the ceramic mold is submerged into the quench medium at a rate such that the quench medium remains behind a solidification front of the metallic composition.

12. The method of claim 1, wherein the ceramic mold is submerged into the quench medium at a rate of about 10 mm/s to about 100 mm/s.

13. The method of claim 1, wherein the casting against gravity comprises creating a pressure differential between a mold chamber containing the heated ceramic mold and a melting chamber containing the molten metallic composition such that the melting chamber comprises a pressure greater than a pressure in the mold chamber that results in the molten metallic composition flowing against gravity and into the heated mold.

14. The method of claim 1, wherein the casting against gravity of the molten metallic composition into the heated mold comprises pumping the molten metallic composition against gravity into the heated mold.

15. The method of claim 1, wherein the casting against gravity of the molten metallic composition into the heated mold comprises upwardly injecting the molten metallic composition against gravity into the heated mold.

16. The method of claim 1 further comprising agitating the liquid quench medium to increase the quench rate.

17. The method of claim 1 wherein the heated ceramic mold is loaded into a mold chamber having an opening in fluid communication with the gate inlet of the ceramic mold, the mold chamber further including a filling tube extending away from the opening of the mold chamber and in fluid communication with the gate inlet of the ceramic mold;

wherein the filling tube extends away from the mold chamber and is configured to extend through a bend down into the molten metallic composition.

18. The method of claim 17 wherein the gate inlet and the filling tube are exposed to air prior to the quenching causing the molten metallic composition in the gate inlet and filling tube to cool and solidify more rapidly than the molten metallic composition within the ceramic mold, wherein the solidifying of the molten metallic composition within the filling tube and the gate inlet prevents the molten metallic composition within the ceramic mold from flowing out of the gate inlet.

* * * * *